US005104036A

United States Patent [19]

Rutkowski et al.

[11] Patent Number: 5,104,036

[45] Date of Patent: Apr. 14, 1992

[54] MAILER WITH REPLY ENVELOPE

[75] Inventors: Lawrence Rutkowski, Aurora; Bruce Morrison, Buffalo; Omar Attia, Hamburg, all of N.Y.

[73] Assignee: Avery International Corporation, Pasadena, Calif.

[21] Appl. No.: 550,962

[22] Filed: Jul. 11, 1990

[51] Int. Cl.[5] ..... B65D 27/06

[52] U.S. Cl. ..... 229/301; 229/314; 229/316; 229/70

[58] Field of Search ..... 229/69, 70, 71, 72, 229/73, 1; 282/11.5 A, 11.5 R

[56] References Cited

U.S. PATENT DOCUMENTS

| | | | |
|---|---|---|---|
| 2,396,221 | 3/1946 | Yancey | 282/11.5 R X |
| 3,113,716 | 12/1963 | Howard . | |
| 3,131,854 | 5/1964 | Deutschmeister . | |
| 3,184,150 | 5/1965 | Hubbard . | |
| 3,419,286 | 12/1968 | Noonan et al. | 282/11.5 A |
| 3,652,007 | 3/1972 | MacDougall . | |
| 3,977,597 | 8/1976 | Wise . | |
| 3,995,808 | 1/1976 | Kehoe . | |
| 4,044,942 | 8/1977 | Sherwood | 229/73 |
| 4,380,315 | 4/1983 | Steidinger | 282/11.5 A X |
| 4,437,852 | 3/1984 | Volk, Jr. . | |
| 4,524,903 | 6/1985 | Vath | 229/92.3 |
| 4,625,909 | 12/1986 | Ferrando | 229/92.1 |
| 4,632,427 | 12/1986 | Angus | 282/11.5 R |
| 4,706,878 | 11/1987 | Lubotta et al. . | |
| 4,754,915 | 7/1988 | Steidinger | 229/69 X |
| 4,756,468 | 7/1988 | Jenkins | 229/73 |
| 4,896,823 | 1/1990 | Taylor | 229/73 |
| 4,923,112 | 5/1990 | Dale | 229/73 X |
| 4,960,237 | 10/1990 | Bendel | 229/69 X |

*Primary Examiner*—Stephen Marcus
*Assistant Examiner*—Jes F. Pascua
*Attorney, Agent, or Firm*—Poms, Smith, Lande & Rose

[57] ABSTRACT

A multi-purpose mailer for sending a message to an addressee for which a response is desired via a reply envelope which is provided by the sender of the mailer. The mailer has two sheets so that the mailer is of a uniformed thickness. When folded, one of the sheets acts as a transmittal envelope portion which may be used to send the mailer to the addressee. One end of the mailer detaches from the remaining portion of the mailer and comprises a reply envelope which the addressee may send back to the sender of the mailer in response to a message printed on the second sheet opposite the transmittal envelope portion.

20 Claims, 3 Drawing Sheets

FIG. 1
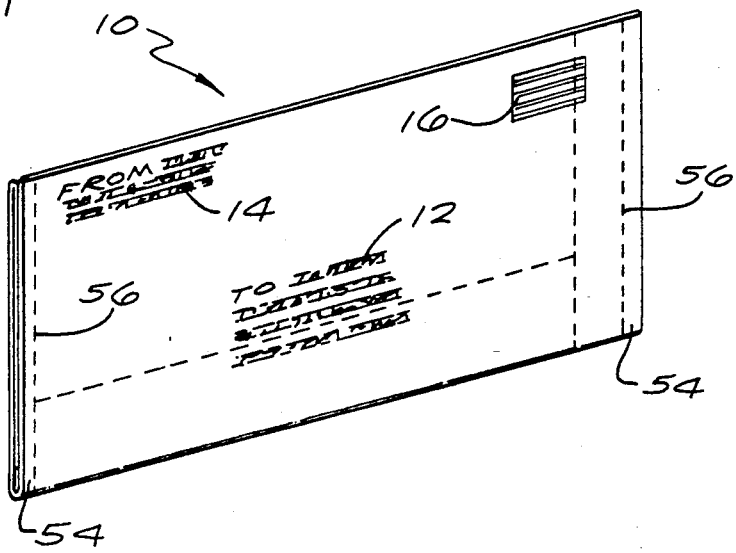
FIG. 3
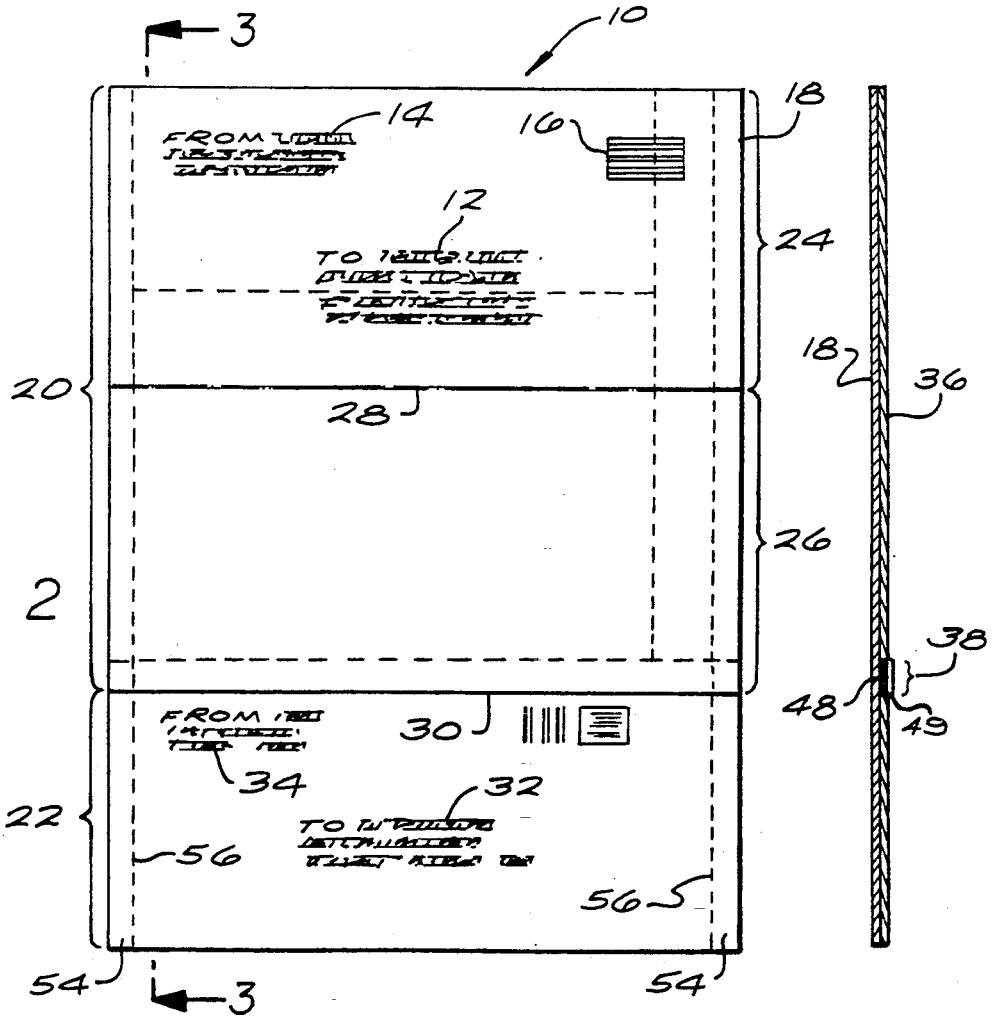
FIG. 2

FIG. 6
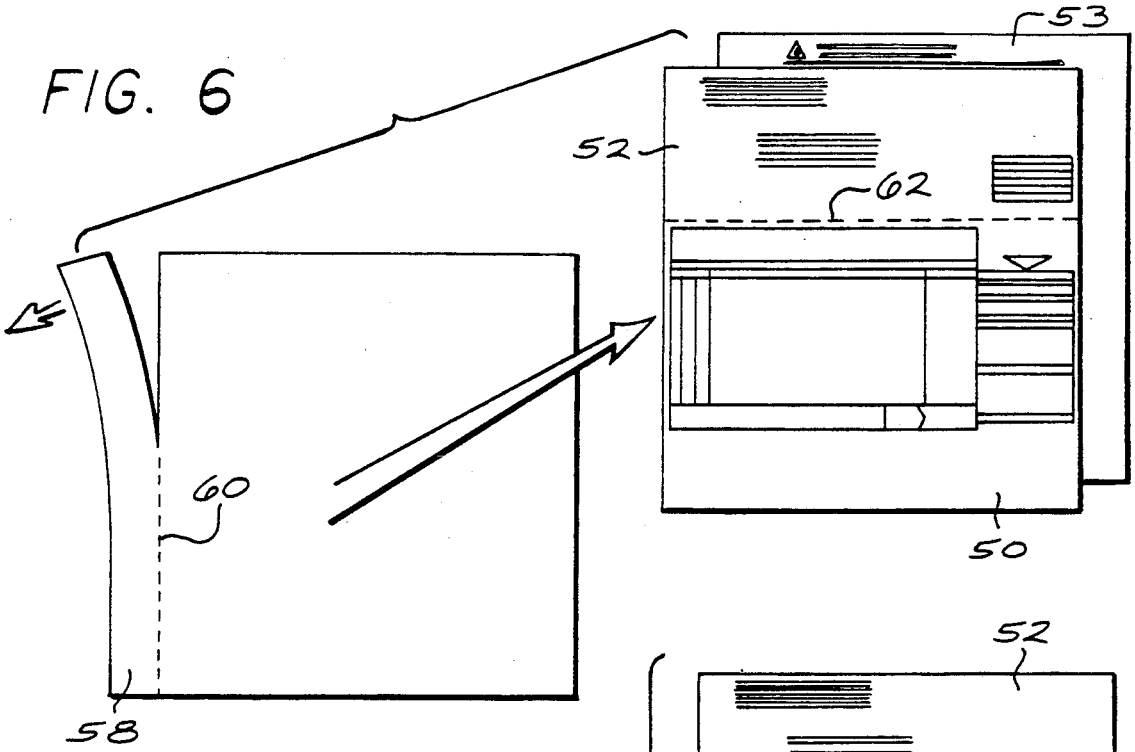
FIG. 7
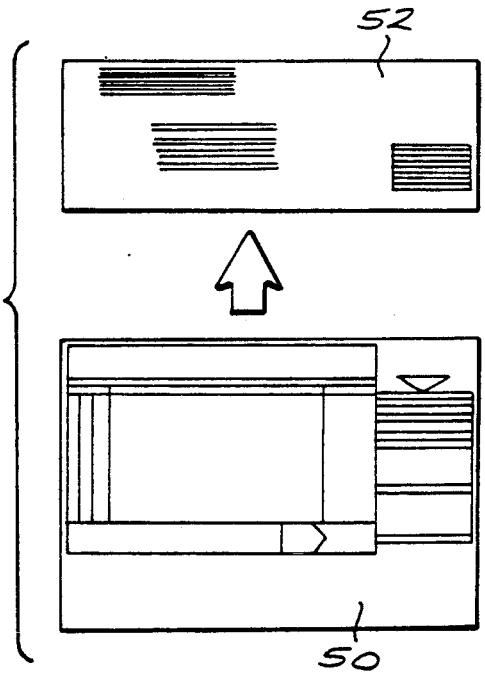
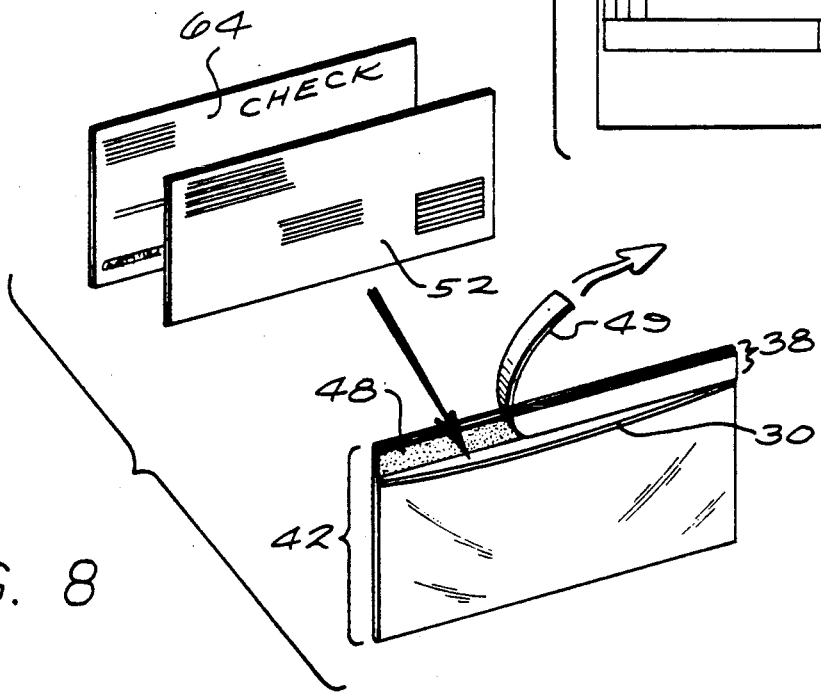
FIG. 8

MAILER WITH REPLY ENVELOPE

BACKGROUND OF THE INVENTION

The invention relates to multi-purpose mailers for sending a message to an addressee for which a response is desired via a reply envelope which is provided by the sender of the mailer.

A number of industries use mailers to bill customers or make other inquiries which are intended to elicit a response from the customers. Accordingly, these mailers provide structure for a transmittal envelope to send the mailer to customers. Additionally, the message to the customer is also provided in the mailer. If a reply from the customer is required, or if it is desirable to facilitate a reply, a reply envelope is provided in the mailer. A multi-purpose mailer serves all these purposes.

In general, multi-purpose mailers are produced using specialized equipment for folding and assembling the mailer, as well as for printing thereon. One type of mailer has a separate detached reply envelope provided within the sender's envelope along with the message to be received by the addressee. This type of mailer requires special machinery for stuffing the transmitted envelopes and printing the envelopes.

It is desirable to provide a low cost mailer which can be used efficiently by businesses. Multiple-piece mailers increase cost and complexity as compared to a single integrated mailer. A small business does not have the facilities to manufacture its own mailers. Therefore, in order for a small business to produce a mailer having personalized messages with variable indicia, it is necessary that separate inserts be prepared and multiple-part mailers be used despite their disadvantages.

Another type of multi-purpose mailer which attempts to minimize the complexity by reducing the number of pieces is constructed from a single sheet or "web." On one side of the single sheet the addressee's address and sender's return address are provided so when folded the single sheet acts as the transmittal envelope. Printed indicia, both fixed and/or variable, is provided on the opposite side of the sheet or in a separate enclosure. The reply mechanism consists of a folded and sealed portion of the single sheet or a separate envelope attached to the single sheet on the other side from the transmittal envelope side. These types of mailers require either special mechanisms for folding the reply envelope for a single sheet mailer or for attaching the reply mechanism to a single sheet mailer.

Typical mailers are not well suited for printing variable indicia thereon with a conventional laser printer. The single sheet type mailer is usually larger than that used by a conventional printer and is often an irregular shape to accommodate the mailer reply portion. If the reply envelope is attached to a single sheet or the mailer is prefolded, the resultant mailer is of a non-standard or a non-uniform thickness that a conventional laser printer will be unable to print variable indicia thereon.

SUMMARY OF THE INVENTION

An important object of the present invention is to provide a mailer of uniform thickness.

Another object of the invention is to provide a mailer which may be used for multiple purposes. These purposes include sending the mailer the addressee, providing a message portion, and providing a means by which the addressee may send a reply to the sender of the mailer.

Yet another object of the invention is to provide a mailer on which variable indicia may be applied by a conventional printing apparatus, such as a conventional laser printer.

A further object of the invention is to provide an economical simple mailer.

A still further object of the invention is to overcome disadvantages of conventional mailers.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein, one specific mailer illustrating the principles of the invention may be of uniform thickness for ease in applying variable indicia thereto and sending to an addressee including a reply envelope for the addressee, comprises a first rectangular sheet having a transmittal envelope portion and a reply envelope front panel, the transmittal envelope portion having a transmittal envelope front panel and a transmittal envelope back panel, the transmittal envelope front panel being separated from the transmittal envelope back panel by a transmittal envelope fold line; with the reply envelope panel being separated from the transmittal envelope back panel by a reply envelope line, and the reply envelope panel is operable to fold over between the transmittal envelope front panel and the transmittal envelope back panel. A second rectangular sheet coextensive with the first rectangular sheet is bonded to the first rectangular sheet along three edges so that the reply envelope front panel is sealed to the second rectangular sheet along the outer edges. The second rectangular sheet has a first portion and a second portion, the first portion extending to a first line above the reply fold line, the second portion having a reply envelope back panel overlying said reply envelope front panel, and a sealing adhesive stripe applied to the side of the first rectangular sheet facing the second rectangular sheet along an area immediately above the reply envelope front panel for sealing the reply envelope front panel to the reply envelope back panel.

One aspect of the invention is to provide a mailer with a customer receipt portion in the second rectangular sheet having a reduced width for insertion into the reply envelope.

Another aspect of the invention is to provide a mailer with a reply envelope sealed by an adhesive stripe. A removable strip of the second rectangular sheet is applied over the adhesive stripe.

A further aspect of the invention is to provide a mailer with perforated lines having perforations extending through the first and second rectangular sheet for forming panels including a customer receipt panel of reduced width.

The accompanying drawings, which are incorporated in and constitute a part of the specification, illustrate an embodiment of the invention, and, together with the description, serve to explain the principles of the invention.

BRIEF DESCRIPTION OF THE DRAWINGS

FIG. 1 is a folded mailer in accordance with a preferred embodiment of the invention;

FIG. 2 is an illustration of the mailer of FIG. 1 as unfolded and laid flat showing the first side of the mailer;

FIG. 3 is a cross sectional view of the mailer of FIG. 2 taken along longitudinal cross-sectional line 3—3 of FIG. 2;

FIG. 6 is an illustration of a second step to be taken in assembling the mailer for reply;

FIG. 7 is an illustration of a third step in assembling the mailer for reply; and FIG. 8 is an illustration of the final step in assembling the mailer for reply.

DESCRIPTION OF THE PREFERRED EMBODIMENT

Figure 4:
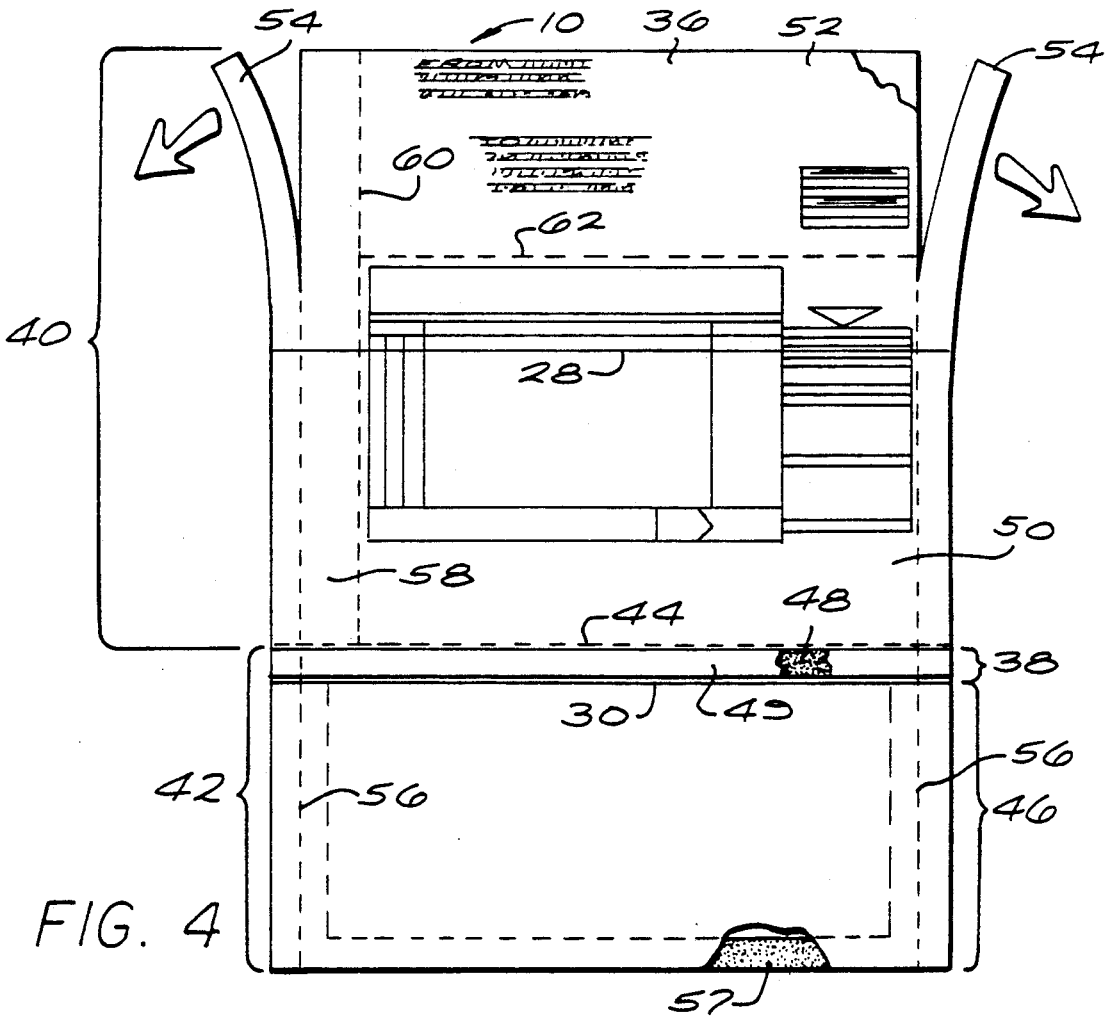
FIG. 4 is an illustration of the second side of the mailer of FIG. 2.

Referring to FIG. 1, a multi-purpose mailer 10 of the present invention is illustrated as folded to be sent from the sender to the addressee. An address of the addressee 12 and a return address for the sender 14, is printed on the outside of multi-purpose mailer 10. Multi-purpose mailer 10 is folded and sealed to form a transmittal envelope as will be described below, and postage 16 is affixed to the outside of the mailer.

The mailer of FIG. 1 is illustrated in FIG. 2 as unfolded and unsealed. In FIG. 2 like reference numerals refer to like structures. FIG. 2 shows a first sheet 18 of mailer 10.

In accordance with the invention, a first sheet 18 has a transmittal envelope portion 20 and a reply envelope front panel 22. Transmittal envelope portion 20 has a transmittal envelope face panel 24 and a transmittal envelope back panel 26.

Transmittal envelope front panel 24 and transmittal envelope back panel 26 are separated by transmittal envelope fold line 28. Reply envelope front panel 22 is separated from transmittal envelope portion 20 by a reply envelope fold line 30.

When the creases are made in mailer 10 at transmittal envelope fold line 28 and reply envelope fold line 30, reply envelope front panel 22 is folded over between transmittal envelope front panel 24 and transmittal envelope back panel 26. When mailer 10 is folded in accordance with the creases made at transmittal envelope fold line 28 and reply envelope fold line 30, mailer 10 appears as illustrated in FIG. 1 with sender's return address 14 and addressees address 12 facing out for mailing to the addressee. Reply envelope front panel 22 is concealed within mailer 10.

Preferably, reply envelope front panel 22 bears address indicia for the addressee to reply to the sender. Sender's address 32 is pre-printed on reply envelope face panel 22 in the preferred embodiment of the invention. Sender's return address 14 can also be pre-printed in the preferred embodiment. Reply envelope face panel 22 also has a reply return address area 34 which is provided for the return address of the sender of the reply envelope. Reply return address area 34 may be left blank for the sender to enter the correct address, or appropriate variable indicia may be printed in the reply return address area by a laser printer or the like at the time that the addressee's address 12 is printed.

A number of perforations or perforated lines are illustrated in FIGS. 1 and 2 for first sheet 18. These perforated lines refer to tear-away sections of first sheet 18. These lines will be discussed in greater detail below.

FIG. 3 is a cross-sectional view taken along cross-sectional line 3—3 of FIG. 2. This cross-sectional view of multipurpose mailer 10 shows the double sheet configuration of mailer 10. That is, according to the invention, a second rectangular sheet coextensive with the first rectangular sheet and bonded to the first rectangular sheet along three edges so that the reply envelope front panel is sealed to the second rectangular sheet along the outer edges is provided. Preferably, the second rectangular sheet 36 is bonded to first rectangular sheet 18 and sealed along outer edges of rectangular sheets 18 and 36.

FIG. 3 also illustrates a portion of rectangular sheet 36 which is designated as a sealing adhesive area 38. Sealing adhesive area 38 includes a sealing adhesive stripe 48 and removable strip 49. In the preferred embodiment sealing adhesive stripe 48 is applied to the side of first rectangular sheet 18 facing second rectangular sheet 36 along an area immediately above reply envelope front panel 22. Removable strip 49 does not extend out from second rectangular sheet 36. Rather, removable strip 49 is a silicone coated strip in the same plane and, accordingly, part of second rectangular sheet 36. Sealing adhesive area 38 will be discussed in greater detail below.

FIG. 4 shows the second rectangular sheet 36 of mailer 10. Additionally, FIG. 4 illustrates the first step in the use of multi-purpose mailer 10 in which tears are made along perforation or "perf" lines.

The second rectangular sheet 36 has a first portion 40 and a second portion 42. First portion 40 extends to a first "perf" line 44 above reply envelope fold line 30.

Second portion 42 of second rectangular sheet 36 has a reply envelope back panel 46 overlying reply envelope front panel 22. Second portion 42 also includes sealing adhesive area 38. Sealing adhesive area 38 includes the area from the top of reply envelope fold line 30 to first "perf" line 44. Sealing adhesive area 38 includes a coextensive sealing adhesive stripe 48 applied to the back side of the first rectangular sheet 18 coextensive with sealing adhesive area 38 described with reference to second rectangular sheet 36. Sealing adhesive stripe 48 on the first rectangular sheet 18 is illustrated in the breakaway showing of sealing adhesive area 38 in FIG. 4. In the preferred embodiment a standard permanent pressure sensitive or remoistenable adhesive is applied to sealing adhesive stripe 48 and a removable strip 49, forming part of the second sheet 36 and coated with a conventional silicone release coating, is located over sealing adhesive stripe 48.

Reply envelope front panel 22 and reply envelope back panel 46 are sealed along three edges located along the outside of the mailer 10 within reply envelope sealing area 57. Thus, along fold line 30 and the upper edge of reply envelope back panel 46 an opening is provided for the resulting reply envelope. The reply envelope is sealed using sealing adhesive stripe 48 in the preferred embodiment.

Second rectangular sheet 36 bears printing and variable indicia for a preferred embodiment. The message to the addressee of the multi-purpose mailer, which in the preferred embodiment is a bill, is found in first portion 40.

First portion 40 of second sheet 36 is separated into several portions by perforated lines or score lines. Preferably, first portion 40 includes invoice portion 50, customer receipt portion 52, and invoice strip 58. Invoice strip 58 is located along customer receipt portion 52 and invoice portion 50. Invoice "perf" line 60 separates invoice strip 58 from customer receipt portion 52 and invoice portion 50. "Perf" line 62 separates customer receipt portion 52 from invoice portion 50.

Invoice portion 50 contains pre-printed standard indicia for presenting the bill and variable indicia printed thereon by the sender of the bill particular to the account. Customer receipt portion 52 contains information to be returned with the payment in the reply envelope. The entire form may be printed with the standard indicia and variable indicia at one time in an alternate embodiment.

Additional information can be printed on the back side of first rectangular sheet 18 between the two rectangular sheets. In the preferred embodiment, this informational sheet 53 is coextensive with customer receipt portion 52 and invoice portion 50. Preferably, a form can be provided to collect additional information from the customer on informational sheet 53.

In manufacture of multi-purpose mailer 10, according to preferred embodiment, the two sheets are glued together with second sheet 36 having a gap located in the region of sealing adhesive area 38 for application of the removable strip 49 of second sheet 36. The same permanent pressure-sensitive adhesive is used on all edges and panels as is used on sealing adhesive stripe 48. During manufacture of the multi-purpose mailer 10, according to the presently preferred embodiment, the adhesive is applied to the back side of one or both of first and second sheets 18 and 36 within areas coextensive with edge strips 54, reply envelope sealing area 57, invoice strip 58 and adhesive sealing stripe 48. Of course, adhesive for adhesive sealing stripe 48 can only be applied to the back side of the first sheet 18. Perforations for score lines are applied to both sheets simultaneously. However, perforations may be applied to each of the sheets singly.

Edge strips 54 are located along the outer edges of mailer 10 and are defined by edge "perf" lines 56. Edge "perf" lines 56 serve to separate edge strips 54 from the sides of the corresponding sheets.

A company sending out bills using multi-purpose mailer 10, which does not have the special equipment necessary for manufacturing a mailer, can specify the necessary pre-printed standard indicia to a manufacturer of mailer 10. The individualized mailer can then be completed with the necessary variable indicia for the company's bills, such as the addressees address 12 and return address 14, and invoice amounts specific to each account, by inserting the forms in a standard laser printer. The uniform thickness and standard size of mailer 10, made possible by its novel configuration of elements, facilitate use of a standard laser printer.

The score lines and their operation in the use of multipurpose mailer 10 will now be discussed with reference to FIGS. 4–8, in which like reference numerals refer to like structures.

In the presently preferred embodiment, the bill is received by the addressee in the condition as shown in FIG. 1. Accordingly, mailer 10 must be folded into a transmittal envelope and sealed for mailing.

In order to send multi-purpose mailer 10, according to the present preferred embodiment, adhesive is applied to the exposed surface of second rectangular sheet along edge strips 54 to seal the mailer for mailing. Folds are then made along reply envelope fold line 30 and transmittal envelope fold line 28. The first fold that is made is made along reply envelope fold line 30 so that the portions of edge strips 54 located within reply envelope back panel 46 adhere to portions of edge strips 54 above fold line 30.

The second fold in assembling the transmittal envelope of mailer 10 is made along transmittal envelope fold line 28. Accordingly, adhesive applied along edge strips 54 in the area of the second rectangular sheet 36 located above transmittal envelope fold line 28 adheres to the edge strips of first rectangular sheet 18 located along reply envelope front panel 22 which was previously folded at fold line 30.

When a customer receives a bill as presented in the preferred embodiment and illustrated in FIG. 1, the first step is to open mailer 10 by opening the transmittal envelope. FIG. 4 shows along which perforations edge strips are detached in order to open mailer 10. As shown in FIG. 4, edge strips 54 detach along edge "perf" lines 56. Thus, the recipient of mailer 10 would receive an envelope as folded in FIG. 1 and detach folded edge strips 54 along folded edge "perf" lines 56.

Figure 5:
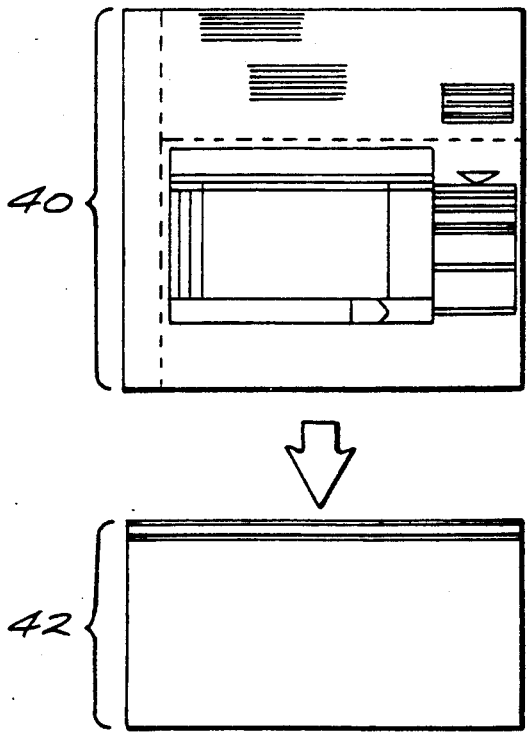
FIG. 5 is an illustration of a step in use of the mailer showing separation of the reply envelope.

FIG. 5 illustrates the second step of using mailer 10. The recipient of mailer 10 separates first portion of second rectangular sheet 36 and the corresponding coextensive portion of first rectangular sheet 18 from second portion 4 of second rectangular sheet 36 and the corresponding coextensive portion of first rectangular sheet 18. The separation occurs along first "perf" line 44. The separation of these two parts of the mailer, as shown in FIG. 5, constitutes separating the reply envelope from the bill portion of mailer 10 in a preferred embodiment of the present invention.

The separation of the reply envelope from the remainder of the bill occurs along first rectangular sheet 18 due to the presence of sealing adhesive area 38. That is, during manufacture of mailer 10 a portion of second rectangular sheet 36 is removed and replaced with silicone coated removable strip 49 to accommodate sealing adhesive area 38. In another embodiment of the invention, the second rectangular sheet 36 has a gap with no removable strip 49 in the sealing adhesive area 38 and a remoistenable gum adhesive is applied along sealing adhesive stripe 48.

As illustrated in FIG. 5, the second portion 42 of second sheet 36 in combination with the coextensive portion of first sheet 18 corresponds to the reply envelope after the separation step along first "perf" line 44. The reply envelope is sealed along three edges by the adhesive applied in reply envelope sealing area 57. First portion 40 now corresponds to the mailer message which in the preferred embodiment is the bill portion of mailer 10.

FIG. 6 illustrates a third separation step in using multipurpose mailer 10. According to a present preferred embodiment an adhesive is applied between first rectangular sheet 18 and second rectangular sheet 36 along invoice area 58. No other adhesive is applied between first rectangular sheet 18 and second rectangular sheet 36 in the area of invoice portion 50 or customer receipt portion 52. Thus, after the step illustrated in FIG. 6 of removing invoice strip 58 along invoice "perf" line 60, informational portion 53 of first rectangular sheet 36 is totally separated from second rectangular sheet 18 in the region of invoice portion 50 and customer receipt 52. Further, the width of invoice sheet portion 50, customer receipt portion 52, and informational portion 53 are such that they will fit within the return envelope.

FIG. 7 illustrates a final separation step before preparing the reply. Invoice portion 50 is separate from customer receipt portion 52 along "perf" line 62. Customer receipt 52, along with informational portion 53, if necessary, are returned to the sender of mailer 10. Customer receipt portion 52 contains information indicating the amount paid and identifying the payor.

Invoice portion 50 is retained by the customer for record keeping purposes in the presently preferred embodiment. Invoice 50 has printed thereon variable indicia indicating the status of the customers account and the status of the current bill.

As illustrated in FIG. 8, the customer then encloses the customer receipt portion 52 with the payment 64 in the reply envelope consisting of second portion 42 of second rectangular sheet 36 and coextensive portions of first rectangular sheet 18. Customer receipt portion 52 has a width which is such that portion 52 fits within the interior of the reply envelope as defined by reply envelope sealing area 57. As illustrated, releasable strip 49 is then removed from sealing adhesive stripe 48. Sealing adhesive stripe 48 is then folded at reply envelope fold line 30 to seal the reply envelope for mailing.

It will be apparent to those skilled in the art that various modifications and variations can be made in the mailer of the present invention without departing from the scope or spirit the invention. Thus, it is intended that the present invention cover the modifications and variations of this invention provided they come within the scope of the appended claims and their legally permissible equivalents.

We claim:

1. A mailer of uniform thickness for applying variable indicia thereto and sending to an addressee including a reply envelope for the addressee, said envelope having outer edges, and an interior width, said mailer consisting solely of two complete sheets comprising:

a first rectangular sheet having two sides, a transmittal envelope portion and a reply envelope front panel having outer edges, said reply envelope front panel being disposed at the bottom of said first rectangular sheet;

said transmittal envelope portion having a transmittal envelope front panel and a transmittal envelope back panel;

said transmittal envelope front panel being separated from said transmittal envelope portion back panel by a transmittal envelope fold line;

said reply envelope front panel being separated from said transmittal envelope portion by a reply envelope fold line;

said reply envelope front panel being operable to fold over between said transmittal envelope front panel and said transmittal envelope back panel; and a second rectangular sheet having outer edges, coextensive with said first rectangular sheet and bonded to said first rectangular sheet along three edges so that said reply envelope front panel is sealed to said second rectangular sheet along the outer edges, said second rectangular sheet having a first portion, a second portion, and a removable strip intermediate said first portion and said second portion, and said first and second sheets having sides facing one-another;

said first portion extending to a first line above the reply envelope fold line;

said second portion having a reply envelope back panel overlying said reply envelope front panel;

a sealing adhesive stripe applied to the side of said first rectangular sheet facing said second rectangular sheet along an area immediately above the reply envelope front panel and underlying said removable strip for sealing the reply envelope front panel to said reply envelope back panel;

said first and second sheets being bonded together by adhesive; and said first and second sheets both having removable panels for insertion in the reply envelope.

2. A mailer according to claim 1 wherein the removable panel of said second rectangular sheet is connected to said second rectangular sheet along perforated lines, and said removable panel having areas for applying printed matter thereto.

3. A mailer according to claim 2 wherein said removable panel has a width less than the interior width of said reply envelope front panel and reply envelope back panel when sealed together.

4. A mailer according to claim 1 wherein first rectangular sheet includes a first pair of edge strips having two sides, said second rectangular sheet includes a second pair of edge strips having two sides, said first and second pair of edge strips are coextensive and have adhesive applied to the side of said first pair of edge strips facing the side of said second pair of edge strips, and said first and second pairs of edge strips are detachably connected to said first rectangular sheet and second rectangular sheet via respective perforated lines.

5. A mailer according to claim 1 wherein said sealing adhesive stripe includes a pressure sensitive adhesive.

6. A mailer of uniform thickness for applying variable indicia thereto and sending to an addressee including a reply envelope having an interior width and outer edges for the addressee, said mailer consisting solely of two complete sheets comprising:

a first rectangular sheet having two sides, a transmittal envelope portion and a reply envelope front panel having outer edges, said reply envelope front panel being disposed at the bottom of said first rectangular sheet;

said transmittal envelope portion having a transmittal envelope front panel and a transmittal envelope back panel;

said transmittal envelope front panel being separated from said transmittal envelope back panel by a transmittal envelope fold line;

said reply envelope front panel being separated from said transmittal envelope portion by a reply envelope fold line;

said reply envelope front panel being operable to fold over between said transmittal envelope front panel and said transmittal envelope back panel;

a second rectangular sheet having outer edges, coextensive with said first rectangular sheet and bonded to said first rectangular sheet along three edges so that said reply envelope front panel is sealed to said second rectangular sheet along the outer edges, said second rectangular sheet having a first portion, a second portion, and a removable strip intermediate said first portion and said second portion, and said first and second sheets having sides facing one-another;

said first portion extending to a first line above the reply envelope fold line;

said second portion having a reply envelope back panel overlying said reply envelope front panel; and a sealing adhesive stripe applied to the side of said first rectangular sheet facing said second rectangular sheet along an area immediately above the reply envelope front panel and underlying said removable strip for sealing the reply envelope front panel to said reply envelope back panel.

7. A mailer according to claim 6 wherein said first portion of said second rectangular sheet includes a detachable panel connected to said second rectangular sheet along perforated lines, and said detachable panel having areas for applying printed matter thereto.

8. A mailer according to claim 7 wherein said detachable panel has a width less than the interior width of said reply envelope front panel and reply envelope back panel when sealed together.

9. A mailer according to claim 6 wherein first rectangular sheet includes a first pair of edge strips, having two sides, said second rectangular sheet includes a second pair of edge strips having two sides, with one side of each pair facing the other pair of edge strips, said first and second pair of edge strips are coextensive and have adhesive applied to one of the pairs of edge strips facing the other pair, and both of said first and second pairs of edge strips are detachable connected to said first rectangular sheet and second rectangular sheet via respective perforated lines.

10. A mailer according to claim 6 wherein said sealing adhesive stripe includes a pressure sensitive adhesive.

11. A mailer according to claim 6 wherein said sealing adhesive stripe includes a remoistenable adhesive.

12. A mailer of uniform thickness for applying variable indicia thereto and sending to an addressee including a reply envelope for the addressee having an interior width and outer edges, said mailer consisting solely of two complete sheets comprising:

a first rectangular sheet having a transmittal envelope portion and a reply envelope front panel, said reply envelope front panel being disposed at the bottom of said first rectangular sheet;

said transmittal envelope portion having a transmittal envelope front panel and a transmittal envelope back panel;

said transmittal envelope front panel being separated from said transmittal envelope portion back panel by a transmittal envelope fold line;

said reply envelope front panel being separated from said transmittal envelope portion by a reply envelope fold line;

a second rectangular sheet coextensive with said first rectangular sheet and bonded to said first rectangular sheet along three edges so that said reply envelope front panel is sealed to said second rectangular sheet along the outer edges, said second rectangular sheet having a first portion and a second portion and a gap separating said first and said second portions;

said second portion having a reply envelope back panel overlying said reply envelope front panel; and a sealing adhesive stripe applied to one of said rectangular sheets for sealing the reply envelope front panel to said reply envelope back panel to form the reply envelope.

13. A mailer according to claim 12 wherein said first portion of said second rectangular sheet includes a removable panel connected to said second rectangular sheet along perforated lines, and said removable panel having areas for applying printed matter thereto.

14. A mailer according to claim 8 wherein said removable panel has a width less than the interior width of said reply envelope front panel and reply envelope back panel when sealed together.

15. A mailer according to claim 7 wherein first rectangular sheet includes a first pair of edge strips having two sides, said second rectangular sheet includes a second pair of edge strips having two sides, with one side of each pair facing the other pair of edge strips, said first and second pair of edge strips are coextensive and have adhesive applied to one of the pairs of edge strips on the side facing the other pair, and both of said first and second pairs of edge strips are detachably connected to said first rectangular sheet and second rectangular sheet via respective perforated lines.

16. A mailer according to claim 12 wherein said sealing adhesive stripe includes a pressure sensitive adhesive.

17. A mailer according to claim 12 wherein said sealing adhesive stripe includes a remoistenable adhesive.

18. A mailer of uniform thickness for applying variable indicia thereto and sending to an addressee including a reply envelope for the addressee, said envelope having outer edges and an interior width comprising:

a first rectangular sheet having two sides, a transmittal envelope portion and a reply envelope front panel having outer edges;

said transmittal envelope portion having a transmittal envelope front panel and a transmittal envelope back panel;

said transmittal envelope front panel being separated from said transmittal envelope portion back panel by a transmittal envelope fold line;

said reply envelope front panel being separated from said transmittal envelope portion by a reply envelope fold line;

said reply envelope front panel being operable to fold over between said transmittal envelope front panel and said transmittal envelope back panel; and a second rectangular sheet having outer edges, coextensive with said first rectangular sheet and bonded to said first rectangular sheet along three edges so that said reply envelope front panel is sealed to said second rectangular sheet along the outer edges, said second rectangular sheet having a first portion and a second portion, and said first and second sheets having sides facing one another;

said first portion extending to a first line above the reply envelope fold line;

said second portion having a reply envelope back panel overlying said reply envelope front panel;

a sealing adhesive stripe applied to the side of said first rectangular sheet facing said second rectangular sheet along an area immediately above the reply envelope front panel for sealing the reply envelope front panel to said reply envelope back panel;

said first and second sheets being bonded together by adhesive; and said first and second sheets both having removable panels for insertion in the reply envelope; and said first portion including a customer receipt portion and an invoice portion which are separated by a perforated line.

19. A mailer of uniform thickness for applying variable indicia thereto and sending to an addressee including a reply envelope for the addressee, said envelope having outer edges and an interior width comprising:

a first rectangular sheet having two sides, a transmittal envelope portion, and a reply envelope front panel having outer edges;

said transmittal envelope portion having a transmittal envelope front panel and a transmittal envelope back panel;

said transmittal envelope front panel being separated from said transmittal envelope portion back panel by a transmittal envelope fold line;

said reply envelope front panel being separated from said transmittal envelope portion by a reply envelope fold line;

a second rectangular sheet having outer edges, coextensive with said first rectangular sheet and bonded to said first rectangular sheet along three edges so that said reply envelope front panel is sealed to said second rectangular sheet along the outer edges, said second rectangular sheet having a first portion and a second portion, and said first and second sheets having sides facing one-another;

said second portion having a reply envelope back panel overlying said reply envelope front panel; and a sealing adhesive stripe applied to one of said rectangular sheets for sealing the reply envelope first panel to said reply envelope back panel to form the reply envelope;

said first portion including a customer receipt portion and an invoice portion which are separated by a perforated line.

20. A mailer of uniform thickness for applying variable indicia thereto and sending to an addressee including a reply envelope having an interior width and outer edges for the addressee, comprising:

a first rectangular sheet having two sides, a transmittal envelope portion and a reply envelope front panel;

said transmittal envelope portion having a transmittal envelope front panel and a transmittal envelope back panel;

said transmittal envelope front panel being separated from said transmittal envelope portion back panel by a transmittal envelope fold line;

said reply envelope front panel being separated from said transmittal envelope portion by a reply envelope fold line, said reply envelope front panel is operable to fold over between said transmittal envelope front panel and said transmittal envelope back panel;

a second rectangular sheet having outer edges, coextensive with said first rectangular sheet and bonded to said first rectangular sheet along three edges so that said reply envelope front panel is sealed to said second rectangular sheet along the outer edges, said second rectangular sheet having a first portion and a second portion, and said first and second sheets having sides facing one another;

said first portion extending to a first line above the reply envelope fold line;

said second portion having a reply envelope back panel overlying said reply envelope front panel; and a sealing adhesive stripe applied to the side of said first rectangular sheet facing said second rectangular sheet along an area immediately above the reply envelope front panel for sealing said reply envelope front panel to said reply envelope back panel;

said first portion including a customer receipt portion and an invoice portion which are separated buy a perforated line.

* * * * *